US005215846A

United States Patent [19]

Fuller et al.

[11] Patent Number: 5,215,846

[45] Date of Patent: Jun. 1, 1993

[54] TONER AND DEVELOPER COMPOSITIONS WITH COUPLED LIQUID GLASS RESINS

[75] Inventors: Timothy J. Fuller, Henrietta; William M. Prest, Jr., Webster; Ralph A. Mosher, Rochester; Anita C. VanLaeken, Macedon, all of N.Y.

[73] Assignee: Xerox Corporation, Stamford, Conn.

[21] Appl. No.: 843,051

[22] Filed: Feb. 28, 1992

[51] Int. Cl.[5] ..... G03G 9/087; G03G 9/09

[52] U.S. Cl. ..... 430/106; 430/106.6; 430/109; 430/110

[58] Field of Search ..... 430/106.6, 106, 109, 430/110

[56] References Cited

U.S. PATENT DOCUMENTS

| | | | |
|---|---|---|---|
| 3,965,022 | 6/1976 | Strong et al. | 430/110 |
| 4,091,198 | 5/1978 | Smith et al. | 526/178 |
| 4,385,107 | 5/1983 | Tanaka et al. | 430/109 X |
| 4,469,770 | 9/1984 | Nelson | 430/110 |
| 4,528,257 | 7/1985 | Polderman et al. | 430/109 |
| 4,529,680 | 7/1985 | Asanae et al. | 430/106.6 |
| 4,564,573 | 1/1986 | Morita et al. | 430/109 |
| 4,770,968 | 9/1988 | Georges et al. | 430/108 |
| 4,894,309 | 1/1990 | Georges et al. | 430/137 |
| 4,910,114 | 3/1990 | Hosino et al. | 430/106.6 |
| 4,952,477 | 8/1990 | Fuller et al. | 430/109 |
| 4,990,424 | 2/1991 | VanDusen et al. | 430/106.6 |
| 5,158,851 | 10/1992 | Fuller et al. | 430/109 X |

FOREIGN PATENT DOCUMENTS

| | | | |
|---|---|---|---|
| 273574 | 11/1987 | Japan | 430/109 |
| 163755 | 6/1989 | Japan | 430/109 |

*Primary Examiner*—Roland Martin

*Attorney, Agent, or Firm*—E. O. Palazzo; John L. Haack

[57] ABSTRACT

A toner composition comprised of chemically coupled multiblock or liquid glass resin particles with a glass transition temperature of between from about 20° C. to about 65° C., and pigment particles.

24 Claims, No Drawings

TONER AND DEVELOPER COMPOSITIONS WITH COUPLED LIQUID GLASS RESINS

BACKGROUND OF THE INVENTION

This invention is generally directed to toner compositions, and more specifically, the present invention relates to developer compositions with toner compositions comprised of chemically coupled liquid glass or multiblock resins. More specifically, in one embodiment of the present invention there are provided developer compositions formulated by, for example, admixing toner compositions containing coupled multiblock polymeric toner resins with carrier components. In one embodiment of the present invention, there are provided toner compositions with coupled multiblock or liquid glass polymers, such as $Q[-(A-B)_n-Y]_m$, wherein n represents the number of (A—B) repeating polymer segments, A and B represent monomeric or oligomeric segments, Q represents a coupling species, m represents a number of reactive sites on the coupling agent Q, and where Y is a group obtained from post coupling reactions, for example, end group modification or quenching, which components as coupled possess in embodiments of the present invention a desirable low fusion and fusing energy; are easily jettable or processable into toner compositions; possess low interfacial surface energies between the polymer segments enabling low temperature fusing; are optically clear; and with the coupled multi-segment polymers illustrated herein there can in embodiments be fabricated brittle, rubbery, or other similar toner polymers with an optimized melt viscosity profile, that is for example added segments increase the molecular weight, molecular weight distribution, and can increase the melt viscosity of the resulting polymer without substantially adversely influencing the glass transition temperature; and lowering the fusing temperature characteristics of the toner resin. The polymers of the present invention are processable by conventional toner means, that is these materials are extrudable, melt mixable and jettable. The resulting toner materials in an embodiment of the present invention possess excellent triboelectric charging characteristics and also fuse and fix to paper at about 50° to about 100° F. lower than conventional toner polymers, such as styrene methacrylate, containing toners. Also, toner compositions formulated with the aforementioned coupled multi-segment polymers have a number of advantages as illustrated herein. Thus, for example, the toner compositions in an embodiment of the present invention possess lower fusing temperatures, and therefore lower fusing energies are required for fixing, thus enabling less power consumption during fusing, and permitting extended lifetimes for the fuser systems selected. The toners of the present invention can be fused (fuser roll set temperature) at temperatures of between 220° and 270° F. in embodiments of the present invention as compared to a number of currently commercially available toners which fuse at temperatures of from about 300° to about 325° F. With further respect to the present invention, the coupled multiblock, or coupled liquid glass polymers contain, for example, in embodiments thereof oligomeric glassy segments with a glass transition temperature of from about 24° to about 72° C., a degree of polymerization of from about 1 to about 100, while the liquid phase has a degree of polymerization of from about 1 to about 100 or about one quarter to about one third of the molecular weight of the glassy content. When the liquid phase is polybutadiene, the butadiene may be incorporated as 1,4 olefinic cis, trans, or 1,2-vinyl enchainments, and the like. Isoprene behaves similarly. Preferred "nonblocking" properties, that is noncaking or retaining substantially all the properties of a free flowing powder, are obtained with, for example, compositions having a high level of the aforementioned 1,2-vinyl enchainments. In an embodiment, the coupling multiblock polymers of the present invention, wherein A can represent the glassy component and B can represent the liquid component, have a number average molecular weight of from about 3,000 to about 100,000 and preferably from about 6,000 to about 50,000. Also, the economical toner and developer compositions of the present invention are particularly useful in electrophotographic imaging and printing systems, including color, especially xerographic imaging processes that are designed for the generation of full color images.

The electrostatographic process, and particularly the xerographic process, is well known. This process involves the formation of an electrostatic latent image on a photoreceptor, followed by development, and subsequent transfer of the image to a suitable substrate. Numerous different types of xerographic imaging processes are known wherein, for example, insulative developer particles or conductive toner compositions are selected depending on the development systems used. Of known value with respect to the aforementioned developer compositions, for example, are the appropriate triboelectric charging values associated therewith as it is these values that can enable continued constant developed images of high quality and excellent resolution; and admixing characteristics. Specifically, thus toner and developer compositions are known, wherein there are selected as the toner resin styrene acrylates, styrene methacrylates, and certain styrene butadienes including those available as PLIOLITES TM. Other resins have also been selected for incorporation into toner compositions inclusive of the polyesters as illustrated in U.S. Pat. No. 3,590,000. Moreover, it is known that single component magnetic toners can be formulated with styrene butadiene resins, particularly those resins available as PLIOLITE TM. In addition, positively charged toner compositions containing various resins, inclusive of certain styrene butadienes and charge enhancing additives, are known. For example, there are described in U.S. Pat. No. 4,560,635, the disclosure of which is totally incorporated herein by reference, positively charged toner compositions with distearyl dimethyl ammonium methyl sulfate charge enhancing additives. The '635 patent also illustrates the utilization of suspension polymerized styrene butadienes for incorporation into toner compositions, reference for example working Example IX.

In a patentability search report, the following U.S. patents were listed:

U.S. Pat. No. 4,091,198; Patentee: Smith et al.; Issued: May 23, 1978

U.S. Pat. No. 4,528,257; Patentee: Polderman et al.; Issued: Jul. 9, 1985

U.S. Pat. No. 4,910,114; Patentee: Hosino et al.; Issued: Mar. 20, 1985 and noted as background interest U.S. Pat. Nos. 3,965,022; 4,469,770; 4,564,573; 4,770,968 and 4,894,309.

Smith et al. discloses, for example, a continuous process for preparing random copolymers comprised of, for example, diolefins and monovinyl substituted aromatics, and a silicon polyhalide as a polymerization chain terminating agent and gel supressant.

Polderman and Hosino disclose anionic polymers as toner resins, including styrene and styrene copolymers. These references do not appear to use a chain coupling step of similar chains nor do they use silane coupling agents.

Numerous patents are in existence that illustrate toner compositions with various types of toner resins including, for example, U.S. Pat. No. 4,104,066, polycaprolactones; U.S. Pat. No. 3,547,822, polyesters; U.S. Pat. No. 4,049,447, polyesters; U.S. Pat. No. 4,007,293, polyvinyl pyridine-polyurethane; U.S. Pat. No. 3,967,962, polyhexamethylene sebaccate; U.S. Pat. No. 4,314,931, polymethyl methacrylates; U.S. Pat. No. 25,136, polystyrenes; and U.S. Pat. No. 4,469,770, styrene butadienes.

In U.S. Pat. No. 4,529,680, there are disclosed magnetic toners for pressure fixation containing methyl-1-pentene as the main component. More specifically, there are illustrated in this patent, reference column 2, beginning at line 66, magnetic toners with polymers containing essentially methyl-1-pentene as the main component, which polymer may be a homopolymer or copolymer with other alpha-olefin components. It is also indicated in column 3, beginning at around line 14, that the intrinsic viscosity of the polymer is of a specific range, and further that the melting point of the polymer is in a range of 150° to 240° C., and preferably 180° to 230° C. Other patents that may be of background interest include U.S. Pat. Nos. 3,720,617; 3,752,666; 3,788,994; 3,983,045; 4,051,077; 4,108,653; 4,258,116; and 4,558,108.

In addition, several patents illustrate toner resins including vinyl polymers, diolefins, and the like, reference for example U.S. Pat. No. 4,560,635. Moreover, there are illustrated in U.S. Pat. No. 4,469,770 toner and developer compositions wherein there are incorporated into the toner styrene butadiene resins prepared by emulsion polymerization processes.

Furthermore, a number of different carrier particles have been illustrated in the prior art, reference for example U.S. Pat. No. 3,590,000 mentioned herein; and U.S. Pat. No. 4,233,387, the disclosures of which are totally incorporated herein by reference, wherein coated carrier components for developer mixtures, which are comprised of finely divided toner particles clinging to the surface of the carrier particles, are recited. Specifically, there are disclosed coated carrier particles obtained by mixing carrier core particles of an average diameter of from between about 30 microns to about 1,000 microns with from about 0.05 percent to about 3.0 percent by weight based on the weight of the coated carrier particles of thermoplastic resin particles. More specifically, there are illustrated in the '387 patent processes for the preparation of carrier particles by a powder coating process, and wherein the carrier particles consist of a core with a coating thereover comprised of polymers. The carrier particles selected can be prepared by mixing low density porous magnetic, or magnetically attractable metal core carrier particles with from, for example, between about 0.05 percent and about 3 percent by weight based on the weight of the coated carrier particles of a polymer until adherence thereof to the carrier core by mechanical impaction or electrostatic attraction; heating the mixture of carrier core particles and polymer to a temperature, for example, of between from about 200° F. to about 550° F. for a period of from about 10 minutes to about 60 minutes enabling the polymer to melt and fuse to the carrier core particles; cooling the coated carrier particles; and thereafter classifying the obtained carrier particles to a desired particle size. In U.S. Pat. Nos. 4,937,166 and 4,935,326, the disclosures of which are totally incorporated herein by reference, there are illustrated, for example, carrier particles comprised of a core with a coating thereover comprised of a mixture of a first dry polymer component and a second dry polymer component not in close proximity to the first polymer in the triboelectric series. Therefore, the aforementioned carrier compositions can be comprised of known core materials including iron with a dry polymer coating mixture thereover. Subsequently, developer compositions can be generated by admixing the aforementioned carrier particles with a toner composition comprised of resin particles and pigment particles. Other patents include U.S. Pat. No. 3,939,086, which teaches steel carrier beads with polyethylene coatings, see column 6; U.S. Pat. Nos. 3,533,835; 3,658,500; 3,798,167; 3,918,968; 3,922,382; 4,238,558; 4,310,611; 4,397,935 and 4,434,220.

In copending application U.S. Ser. No. 751,922, now abandoned, entitled Developer Compositions With Specific Carrier Particle Developers, the disclosure of which is totally incorporated herein by reference, there are illustrated toners with styrene butadiene copolymers, pigment particles inclusive of magnetites, charge control additives, and carrier particles containing a core with a coating thereover of vinyl copolymers, or homopolymers, such as vinyl chloride/vinyl acetate.

Semicrystalline polyolefin resins or blends thereof are illustrated in U.S. Pat. Nos. 4,990,424 and 4,952,477, the disclosures of which are totally incorporated herein by reference. More specifically, in U.S. Pat. No. 4,952,477 there are disclosed toners with semicrystalline polyolefin polymer or polymers with a melting point of from about 50° to about 100° C., and preferably from about 60° to about 80° C. with the following formulas wherein x is a number of from about 250 to about 21,000; the number average molecular weight is from about 17,500 to about 1,500,000 as determined by GPC; and the $M_w/M_n$ dispersity ratio is from about 2 to about 15.

I. Polypentenes-$(C_5H_{10})_x$
II. Polytetradecenes-$(C_{14}H_{28})_x$
III. Polypentadecenes-$(C_{15}H_{30})_x$
IV. Polyhexadecenes-$(C_{16}H_{32})_x$
V. Polyheptadecenes-$(C_{17}H_{34})_x$
VI. Polyoctadecenes-$(C_{18}H_{36})_x$
VII. Polynonadecenes-$(C_{19}H_{38})_x$; and
VIII. Polyeicosenes-$(C_{20}H_{40})_x$.

Examples of specific semicrystalline polyolefin polymers illustrated include poly-1-pentene; poly-1-tetradecene; poly-1-pentadecene; poly-1-hexadecene; poly-1-heptadecene; poly-1-octadene; poly-1-nonadecene; poly-1-eicosene; mixtures thereof; and the like.

In copending application U.S. Ser. No. 695,880 (filed May 6, 1991) there are disclosed Toner and Developer Compositions with Encapsulated Toners, the disclosure of which is incorporated herein by reference in its entirety.

Although the above described toner compositions and resins are suitable for their intended purposes, especially those of U.S. Pat. Nos. 4,952,477 and 4,990,424, in most instances there continues to be a need for toner and developer compositions containing new resins. More specifically, there is a need for toners which can be fused at lower energies than many of the presently available resins selected for toners but which retain many or all of the same desirable physical properties, for example hardness, processability, durability, and the like. There is also a need for resins that can be selected for toner compositions which are low cost, nontoxic, nonblocking at temperatures of less than 50° C., jettable, melt fusible with a broad fusing latitude, cohesive above the melting temperature, and triboelectrically chargeable. In addition, there remains a need for toner compositions, especially low melt toners, which can be fused at low temperatures, that is for example 260° F. or less, as compared to a number presently in commercial use, which require fusing temperatures of about 300° to 325° F., thereby enabling with the compositions of the present invention the utilization of lower fusing temperatures, and lower fusing energies permitting less power consumption during fusing, and allowing the fuser system, particularly the fuser roll selected, to possess extended lifetimes. Another need resides in the provision of developer compositions comprised of the toner compositions illustrated herein, and carrier particles. There also remains a need for toner and developer compositions containing additives therein, for example charge enhancing components, thereby providing positively or negatively charged toner compositions. Furthermore, there is a need for toner and developer compositions with multiblock polymers that will enable the generation of solid image area with substantially no background deposits, and full gray scale production of half tone images in electrophotographic imaging and printing systems.

There is also a need for chemically coupled multiblock polymers and copolymers thereof, and mixtures of the aforementioned polymers and copolymers with glass transition temperatures of, for example, from about 20° to about 70° C., and preferably from about 33° to about 60° C.; and wherein toner compositions containing the aforementioned resins can be formulated into developer compositions which are useful in electrophotographic imaging and printing systems; and wherein fusing can, for example, be accomplished by flash, radiant, with heated ovens, cold pressure, and heated roller fixing methods in embodiments of the present invention.

SUMMARY OF THE INVENTION

It is an object of the present invention to provide toner and developer compositions which possess many of the advantages illustrated herein.

In another object of the present invention there are provided developer compositions with positively charged toners containing therein chemically coupled multiblock or liquid glass resins.

Also, in another object of the present invention there are provided toner compositions containing therein coupled multiblock polymers as a resinous component, which components have glass transition temperatures of from about 24° to about 72° C., and preferably from about 33° to about 60° C.

Further, in an additional object of the present invention there are provided developer compositions comprised of toners having incorporated therein coupled multiblock resins, and carrier particles.

Furthermore, in another object of the present invention there are provided improved toner compositions which can be fused at low temperatures thereby reducing the amount of energy needed for affecting fusing of the image developed.

Moreover, in another object of the present invention there are provided developers with positively charged toner compositions that possess excellent electrical properties.

Also, in another object of the present invention there are provided developers with stable triboelectric charging characteristics for extended time periods exceeding, for example, 1,000,000 imaging cycles.

Another object of the present invention resides in the provision of toner compositions with excellent blocking temperatures, and acceptable fusing temperature latitudes.

In another object of the present invention there are provided toner and developer compositions that are nontoxic, nonblocking at temperatures of less than 50° F., jettable, melt fusible with a broad fusing latitude, and cohesive above the melting temperature thereof.

Furthermore, in an additional object of the present invention there are provided developer compositions containing carrier particles with a coating thereover comprised of a mixture of polymers that are not in close proximity in the triboelectric series, reference U.S. Pat. Nos. 4,937,166 and 4,935,326, the disclosures of which are totally incorporated herein by reference.

Also, in yet still another object of the present invention there are provided methods for the development of electrostatic latent images with toner compositions containing therein coupled multiblock amorphous polymers as resin particles.

In yet another object of the present invention there are provided developer compositions with carrier components obtained by a dry coating process, which particle possess substantially constant conductivity parameters, and a wide range of preselected triboelectric charging values.

Furthermore, in yet a further object of the present invention there are provided developer compositions with carrier particles comprised of a coating with a mixture of polymers that are not in close proximity, that is for example a mixture of polymers from different positions in the triboelectric series, and wherein the toner compositions incorporated therein possess excellent admix charging values of, for example, less than one minute, and triboelectric charges thereon of from about 10 to about 40 microcoulombs per gram.

Another object of the present invention resides in the provision of toner and developer compositions which are insensitive to humidity of from about 20 to about 90 percent, and which compositions possess superior aging characteristics enabling their utilization for a substantial number of imaging cycles, exceeding 500,000 in some embodiments, with very little modification of the triboelectrical properties, and other characteristics.

Also, in another object of the present invention there are provided low melting toner compositions, that is for example, a glass transition temperature of about 20° C. to about 60° C.

In still another object of the present invention there are provided toner and developer compositions for affecting development of images in electrophotographic imaging apparatus, including xerographic imaging and printing processes.

Still another object of the present invention is to provide toner polymers which pass blocking test requirements below the glass transition temperature of the polymer.

These and other objects can be accomplished in embodiments of the present invention by providing toner and developer compositions comprised of chemically coupled multiblock or liquid glass polymers. More specifically, in one embodiment of the present invention there are provided toner compositions comprised of pigment particles and coupled amorphous multiblock polymers. The aforementioned chemically coupled multiblock polymers in embodiments of the present invention possess a glass transition temperature of from about 24° to about 70° C., and preferably from about 33° to about 60° C. as determined by DSC (differential scanning calorimetry).

More specifically, in one embodiment the coupled multiblock polymers of the present invention are of the formula $Q[-(A-B)_n-Y]_m$ wherein, for example, m represents the number of reactive sites on the coupling agent Q, n represents the number of A and B repeat segments and where A and B represent monomeric or oligomeric segments and Y represents an end group comprising, for example, another A block or an ionic group such as a carboxylic acid group. In the aforementioned formula, Q is derived from a coupling agent, for example those compounds having a central metal atom such as silicon or titanium and having displacable ligands such as halogen atoms or alkoxy groups and the like, which coupling agents are described in "Silane Coupling Agents", by Edwin P. Plueddemann, 2nd Edition, Plenum Press, 1991, the disclosure of which is incorporated herein by reference in its entirety. The subscript m represents the number of displacable groups or ligands in the reactive coupling agent and the number of coupled liquid-glass segments appended to the coupling agent central metal atom after the coupling reaction is completed. The m may be from 2 to about 6 and preferably from 2 to about 4 because of the commercial availability of these materials and the ability of these materials to react completely in a reasonable period of time. The number of A and B repeat polymer segments n, in embodiments of the present invention, is about 2 to about 100, and preferably from about 3 to about 35. Accordingly, the coupled multiblock polymers of the present invention usually contain at least four A segments, and at least two B segments, and up to 400 A and 400 B segments. The number average molecular weight of the coupled multiblock polymers of the present invention depends on the number of A and B segments, the toner properties desired, and the like; generally, however, the number average molecular weight is from about 3,000 to about 100,000 and preferably from about 6,000 to about 50,000. In another embodiment of the present invention, the multiblock polymers are comprised of a glass phase A of, for example, a number of polystyrene segments, and a liquid phase B with, for example, a number of polydiene derived segments, such as polybutadiene. A polystyrene content of between about 70 to about 100 percent by weight of the glassy component is preferred in embodiments of the present invention. A polybutadiene content of between about 15 to about 100 percent by weight of the liquid component is preferred in an embodiment of the present invention. The total butadiene content of the liquid glass resins is between 15 to about 40 percent by weight and the total polystyrene of the liquid glass resins is, for example, between about 60 to about 85 percent by weight. The preferred enchainment of polybutadiene and other polymerized 1,4 dienes in the liquid component in an embodiment of the present invention is the 1,2-vinyl regioisomer of between about 80 to about 90 percent and the 1,4-cis and trans regioisomers of between about 10 to about 20 percent by weight of the total enchained butadiene. Thus, in one embodiment coupled multiblock polymers containing liquid component polybutadiene segments having high 1,2-vinyl butadiene regioisomer enchainments are selected.

The coupled multiblock polymers or liquid glass resins of the present invention in embodiments thereof satisfy the criteria of the known blocking test (anticaking property) below their glass transition temperatures. For example, several coupled multiblock polymers of the present invention have glass transition temperatures near 50° C. and acceptable blocking below 50° C. The blocking test can be accomplished by placing a toner powder sample prepared from the liquid glass resin into a convection oven according to the sequence of one day (24 hours) at 115° F., a second day at 120° F., and a third day at 125° F. The prepared toner samples had excellent powder flow properties and were free flowing or only slightly caked, but easily friable powder was present after incubation periods.

DESCRIPTION OF EMBODIMENTS OF THE PRESENT INVENTION

Low melt toners, that is toner compositions with melting temperatures or glass transition temperatures of about 20° to about 65° C. as determined by known melt rheologic techniques, enable improved performance of electrophotographic copy and printing machines. For example, improvements may include copy quality, start up reliability, more rapid fuser roll warm-up, faster operating speeds, higher copy through-put rates, and glossy color prints for transparencies. These improvements may be further complimented in part by decreased power consumption and reduced fuser set temperature resulting in increased fuser roll life.

Anionic copolymers, prepared from styrene and butadiene and related monomers, form toner resins possessing excellent ultra-low melt toner properties. These low melt toner materials are disclosed in copending application U.S. Ser. No. 07/587,194 entitled TONER AND DEVELOPER COMPOSITIONS WITH LIQUID GLASS RESINS, filed Sep. 24, 1990, now U.S. Pat. No. 5,158,851, the disclosure of which is incorporated in its entirety. The uncoupled liquid-glass resins and toner compositions prepared therefrom possess in embodiments therein resin particles with a glass transition temperature of between from about 20° to about 65° C.

Differences and advantages of the coupled liquid-glass resins of the instant invention to the aforementioned uncoupled liquid-glass resins include, for example, in embodiments higher molecular weight; broader molecular weight distribution; broader fusing latitude; and maintaining nearly the same minimum fix temperature as the uncoupled liquid glass resins;

copolymers of the instant invention are optically clear and resist blocking as toners at 50° C.; and narrow molecular weight distributions of low molecular weight copolymer resin materials as toner resins may lead to a poor or narrower than desirable fusing latitude properties, that is a temperature range or window between which the toner composition will efficiently fuse to a copy sheet at a lower temperature (minimum fix temperature, MFT) and at a higher temperature allow release of the copy sheet bearing a fused toner image from the fuser roller without offsetting the fused toner image to the fuser roller (hot offset temperature, HOT).

As illustrated herein, chemically reactive coupling agents, for example dichlorodimethylsilane, $SiCl_2(CH_3)_2$, may be used to extend the chain by integral lengths and the molecular weight distribution of multiblock or liquid glass copolymers, and thereby increase the fusing latitude of the toner composition. As an example, dichlorodimethylsilane was reacted in situ with a "living" anionic copolymer comprised of initiator, styrene and butadiene monomers to couple about 17 percent of the available reactive polymer ends, based on a theoretical value of available anionic end groups created by the initiator and the amount of coupling agent added. This coupled product was compared to a number of noncoupled or uncoupled control samples (47, 51, 92 and 98), that is copolymers prepared similarly but without the addition of the coupling agent. Fusing evaluations were carried out using a Xerox 5028 silicone roll fuser operated 3.3 inches per second, and with a Xerox 1075 silicone roll fuser operated at eleven (11) inches per second. The physical properties and fusing data obtained for the coupled and uncoupled copolymers are summarized in Table I that follows.

For the uncoupled products, fusing latitudes varied within the range of between 13° and 43°. C. A coupled product obtained using, for example, a silane coupling agent increased the fusing latitude to between 46° and 57° C. without increasing the minimum fix temperature of the toner. There is a corresponding increase in the melt rheology, that is the onset of melting temperature ($T_1$) and the flowability of a sample of the silane coupled polymer toner of Example II compared with that of the uncoupled polymer product toner of Example I. $T_1$ is the melt viscosity (n') (eta prime) for the molten resin at $7.5\times10^4$ poise measured at 10 radians per second. $T_2$ is the molten resin melt viscosity (n') (eta prime) at $4.5\times10^3$ poise measured at 10 radians per second. In general, xerographic toners fix to paper and the fuser between $T_1$ and $T_2$. Molecular weights, as determined by GPC of $M_w/M_n$ 32,700/20,300 for the uncoupled product, increased to 156,000/34,500 for the coupled product of Example II as a result of the silane coupling reaction.

Any suitable di- or multi-functional molecule that reacts with carbon anions to form a chemical bond is suitable as a coupling agent. Use of a mono-functional molecule would usually result in chain termination without coupling of the reaction process affording the equivalent of a quenched reaction product without a significant increase in chain length or molecular weight. Coupling agents useful in the instant invention include dialkyl- or diaryl-dihalosilanes, for example dichlorodimethyl silane and dichlorodiphenyl silane; haloalkyl aromatics such as dibromoxylene; and divinyl aromatics, for example divinylbenzene, diisopropenylbenzene, known activated di-olefins and the like. Similarly, by selection of reactive multifunctional small molecules as coupling agents, and by controlling the duration of reaction, concentration and relative ratio of coupling agent to living polymer, and controlling the timing sequence of the addition of the coupling agent to the reaction mixture, the preparation of novel polymer architectures may be accomplished, for example three dimensional branched, star, and dendritic polymer structures for toner resin application. Related geometric materials have been disclosed, reference for example U.S. Pat. No. 5,019,628, the disclosure of which is totally incorporated herein by reference.

Although not desired to be limited by theory, the reaction and mechanism for chain coupling leading to the observed increases in molecular weight, polydispersity and increased fusing latitudes are consistent with the examples shown in the following scheme.

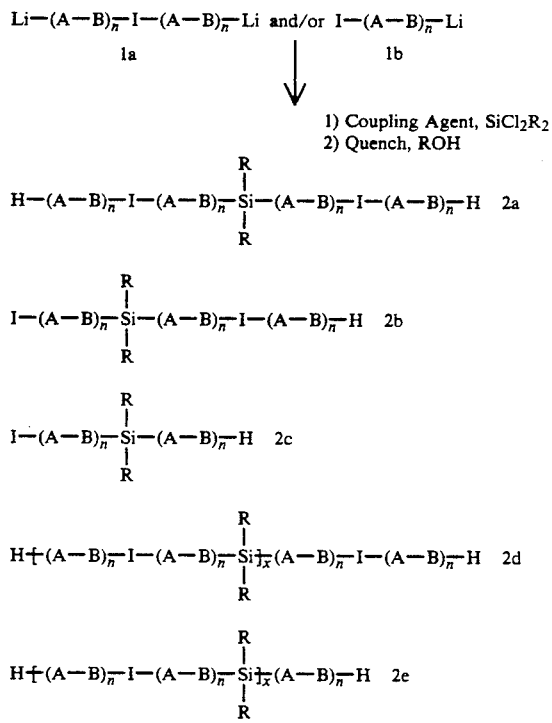

wherein:

I=initiator;

$(A—B)_n$=a multiblock segment;

x represents the number of repeating units; and

R is alkyl containing, for example, 1 to about 25 carbon atoms, and aryl of from 6 to about 24 carbon atoms.

For example, depending upon the choice of initiator (I) and relative mole ratios of organic lithium reagent that are selected to react with a multifunctional initiator, may conveniently generate exclusively either 1a or 1b, or a mixture of 1a and 1b. Further, depending upon the relative mole ratio of coupling agent (Q) to reactive living anionic species 1a and 1b, a wide variety of coupled products may be deliberately produced, for example 2a through 2e. The symmetrical product 2a is obtained from coupling two equivalents of precursor 2a with one equivalent of a difunctional coupling agent, for example dichloro dimethyl silane, $SiCl_2(CH_3)_2$. Similarly, symmetric product 2c is obtained from two equivalents of 1b and one equivalent of a difunctional coupling agent. The mixed, that is unsymmetric, product 2b may be obtained from coupling an equimolar mixture of 1a and 1b with an appropriate quantity of a difunctional coupling agent. Depending on the order of addition of coupling agents and living anionic polymers the product may additionally contain symmetric products 2a and/or 2b.

When solutions or suspensions of the living anionic species, for example, 1a are added to solutions containing the di- or multifunctional coupling agents Q, extended or multiply coupled products of type 2d may be obtained. If mixtures of the living anionic polymers 1a and 1b are added to the coupling agent, mixed multiply extended products of type 2e may be obtained. The multiply coupled or extended products 2d and 2e lead to resins with higher molecular weights and greater polydispersity than the simple coupled products 2a, 2b and 2c, obtained from the same living anions 1a and 1b.

It appears that a coupling of "living" anionic polymers with reactive di- or multifunctional small molecules leads to polymer products possessing increased molecular weight, polydispersity, and fusing latitude while maintaining or decreasing the minimum fix temperature of toners made from the resultant "coupled" copolymer resins. These observations are consistent with chain lengthening and a concommitant increased probability of chain entanglement (enhanced reptation) typically leads to an increase in melt viscosity and fusing temperature of correspondingly higher molecular weight polymers.

Examples of coupled multiblock polymers of the present invention include those as illustrated herein, wherein the glassy component A represents one oligomeric segment such as polystyrene, poly-alphamethyl styrene, and the like, and wherein the liquid component B represents another oligomeric segment, such as polybutadiene, polyisoprene, hydrogenated polybutadiene, hydrogenated polyisoprene, halogenated polybutadiene, halogenated polyisoprene, low molecular weight segments of polyethylene comparable in length to the aforementioned hydrogenated polyolefins, and the like with, for example, hydrogenated, halogenated and related B segments, double bond modifications are best accomplished after isolating the chemically coupled polymer products.

Examples of coupled liquid glass polymers include:

1. coupled multiblock polymers of the formula $$Q[(A-B)_n-Y]_m$$

wherein Q is the coupling agent, A is a glassy segment, B is a liquid segment, and Y is an end group and wherein n is a number of from 2 to about 100; for example, where m=2, there results $$Y-(A-B)_n-Q-(A-B)_n-Y$$

2. coupled glassy terminal multiblock polymers of the formula $$Q[(A-B)_n-A]_m$$

wherein n is a number of from 1 to about 100, m is a number of from 2 to about 10, and wherein ends of the polymer chain are terminated with a glassy component A; for example, a styrene block (Y=A); for example, where m=2, there results $$A-(A-B)_n-Q-(A-B)_n-A$$

3. coupled glassy terminal graded multiblock polymers of the formula $$Q\{[A-(C)_n-]_p-I\}_m$$

wherein n is a number of from 1 to about 50, p is a number of from 1 to 4 that represents the number of arms that extend radially from the initiator site I, I is the point of initiation, that is the singular molecule structural component representing the initiation site, for example the reaction product of diisopropenyl benzene and excess butyl lithium, (C) represents graded or gradient block domains composed of from 3 monomers to about 350 monomers that become progressively enriched in the number of glassy A segments and depleted in the number of liquid B segments as the chain extends away from the point of initiation, that is the number of A blocks is farther away or remote from (distal) the initiation site I, and the number of B blocks is greater proximal to the initiation site I, and m represents the number of reactive sites on the coupling agent Q, for example, when p=4 and m=2

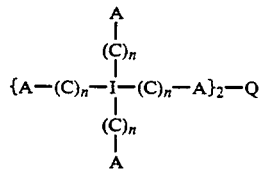

4. coupled {glassy terminal graded segmented multiblock} polymers of the formula $$Q\{[A-(C)_n-(B)_o-]_p-I\}_m$$

wherein n is a number of from 1 to about 50, o is a number of from 1 to about 25, (B) represents regions of essentially all liquid B component spacer segment, and (C), I and p and m are as illustrated in 3. above; for example, wherein n=1, o=1, p=2, and m=2 as $$\{[A-(C)(B)-]-I-[-(B)(C)-A]\}-Q-\{[A-(C)(B)-]-I-]-(B)(C)-A]\}$$

5. coupled {glassy terminal graded multi-segmented multiblock} polymers of the formula $$Q\{[A-\{-(C)_n-(B)_o-\}_q-]_p-I\}_m$$

wherein n is a number of from 1 to about 50, o is a number of from 1 to about 25, q is a number from 1 to 50 that represents the number of linearly repeated segments of the multiblock segment combination, $-(C)_n-(B)_o-$ contained in the small curly brackets, and (C), I and m and p are as specified in 3 and 4 above; for example where n=1, o=1, p=2, q=2, and m=2 as in $$Q\{[A-(C)(B)-(C)(B)-]-I-[(B)(C)-(B)(C)-A]\}_2$$

6. ionizable terminal coupled multiblock polymers of the formula $$Y'-Z-Y' \text{ or } Z-Y'$$

wherein the coupled liquid glass polymer chain end groups are modified so as to terminate in Y' groups on one or more ends of the polymer chain that are capable of ionization and hydrogen bonding, for example the hydroxyl, —OH, or carboxyl, $-CO_2H$, radicals and their corresponding metal salts, for example lithium, sodium, potassium, magnesium, aluminum and the like, and wherein Z represents a coupled multiblock polymer selected from and defined by the aforementioned Types 1 through 5. Specifically, Type 6 compounds are obtained by quenching and, therefore, terminating the reaction mixture described for the preparation of the aforementioned coupled resin Types 1 through 5 with, for example, carbon dioxide, hydrolyzable carbonates and acid chlorides, and the like, or various epoxide containing compounds;

7. hydrogenated derivatives of Types 1 to 6 above, examples of which are prepared by anionic polymerization and coupling followed by catalytic hydrogenation; and 8. halogenated derivatives of Types 1 to 6 above, examples of which are prepared by anionic polymerization and coupling followed by stoichiometric halogenation of the 1,4-olefinic and 1,2-vinylic double bonds with, for example, liquid bromine or dissolved gaseous chlorine.

The coupled multiblock liquid glass resins can be represented by the following formulas wherein the substituents are as indicated herein: Type 1 $Q[(A—B)_n—Y]_m$ multiblock polymers wherein the polymer chain contains at least two alternating blocks or segments of glassy polystyrene or related polyolefin; Type 2 $Q[(A—B)_n—A]_m$ glassy terminal multiblock polymers, that is the multiblock polymers of Type 1 that are terminated on the ends of the polymer chain with glassy A regions; Type 3 $Q\{[A—(C)_n—]_p—I\}_m$ glassy terminal graded multiblock polymers, that is gradient multiblock polymers that are end terminated with glassy A regions, which materials are typically prepared in a one step single pot reaction followed by coupling and quenching; Type 4 $Q\{[A—(C)_n—(B)_o—]_p—I\}_m$ coupled glassy terminal graded segmented multiblock polymers, that is gradient multiblock polymers that are terminated with glassy A regions, and additionally have a region of essentially all liquid B component segments separating the graded multiblock domains, these materials are prepared in multiple addition step reactions often in a single pot followed by coupling and quenching; and Type 5 $Q\{[A—\{—(C)_n—(B)_o—\}_q—]_p—I\}_m$ coupled glassy terminal graded multi-segmented multiblock polymers, that is gradient multiblock polymers that are terminated with glassy A regions, and additionally have multiple regions of essentially all liquid B component segments separating a plurality of graded multiblock C domains, further the individual graded C segments within the contiguous polymer chain contain local termi that are essentially all glassy A regions that are reacted further by coupling and quenching.

In embodiments, preferred coupled liquid glass polymer structures are of Type 3, and particularly preferred are Types 4 and 5. Coupled liquid glass polymers of Type 3 are preferred, for example, since their preparation is simple, that is a one pot synthesis requiring a single monomer step, while structures of Types 4 and 5, although less convenient to prepare, are particularly preferred because of their superior performance characteristics such as lowered minimum fix temperature and elevated hot offset temperature properties in embodiments of the present invention.

Specific examples of coupled multiblock polymers include silane coupled polystyrene glass-polybutadiene liquid-polystyrene glass with a number average molecular weight of from about 3,000 to about 70,000; silane coupled polystyrene glass-polyisoprene liquid-polystyrene glass with a number average molecular weight of from about 5,000 to about 70,000; silane coupled hydrogenated (polystyrene glass-polybutadiene liquid-polystyrene glass) with a number average molecular weight of from about 4,000 to about 70,000; hydrogenated coupled (polystyrene glass-polyisoprene liquid-polystyrene glass) with a number average molecular weight of from about 4,000 to about 70,000; ionizable coupled polystyrene glass-polybutadiene liquid-polystyrene glass with a number average molecular weight of from about 3,000 to about 60,000; halogenated, especially chlorinated coupled (polystyrene glass-polybutadiene liquid-polystyrene glass) with a number average molecular weight of from about 3,000 to about 100,000; and halogenated, especially chlorinated coupled, (polystyrene glass-polyisoprene liquid-polystyrene glass) with a number average molecular weight of from about 3,000 to about 100,000.

In embodiments, the phrase "liquid glass" resins is intended to illustrate the physical and mechanical properties of the material, which is analogous to liquid crystalline polymers that exhibit certain concurrent physical properties that are at once characteristic to both the liquid state and crystalline solid state. Similarly, semicrystalline resins have structures that contain both crystalline and amorphous regions in the same polymer molecule.

While not being desired to be limited by theory, it is believed that the combination of crystalline regions and amorphous regions in the same molecule imparts upon the resin product certain physical and mechanical properties that are unlike either purely crystalline or amorphous resins, and different physical and mechanical properties from a simple physical blend of like proportions of the pure materials. That is, by selectively constructing specific molecular architectures, for example by controlling the degree of blockedness or randomness, the chemical composition, the regiochemistry of the diene monomer reaction, chemistry of the end groups, the size of the blocks, and the extent of coupling, it is possible to obtain resin products with unique and useful rheological properties in an embodiment of the present invention as indicated herein. Although not limited by theory, it is believed that the unique properties of coupled liquid glass resins described herein derive from the unencumbered intra- and intermolecular interaction and mixing of the liquid and glass component microdomains, and from increased molecular weight and polydispersity deriving from the coupling reaction. Surprisingly, in embodiments the coupling reaction does not substantially alter the "liquid glass" characteristics from the parent polymer but does allow for subtle manipulation of important rheological properties.

Liquid of the "liquid glass" resin refers to, for example, an oligomer or polymer segment that is above its glass transition point and exhibits properties characteristic of a melted glass or molten solid in flowability, pourability and conforms closely to the dimensions of containment. The word "glass" in "liquid glass" refers to, for example, a polymer or polymer segment that is below its glass transition point and exhibits properties characteristic of a supercooled liquid, such as being an amorphous solid of high hardness, of high optical clarity, easily liquefied upon heating, and is friable as, for example, polystyrene or common inorganic silicate glasses.

Although not desired to be limited by theory and while other meanings of the term liquid glass could be envisioned, the properties of the liquid glass multiblock and particularly coupled liquid glass multiblock polymers are believed to be distinct from the other well known polymer classes such as crystalline, semicrystalline, liquid crystalline, and amorphous materials as summarized in the following references, the disclosures of which are totally incorporated herein by reference, *Macromolecules*, second edition, Vol. 1, by Hans-Georg Elias, Plenum Press, N.Y., 1984; *Textbook of Polymer Science*, second edition, by Fred W. Billmeyer, Jr., Wiley-Interscience, N.Y., 1971; and *Block Polymers*, Ed. S. L. Aggarwal, Plenum Press, N.Y., 1970.

Typical properties of crystalline polymers include a highly ordered solid state, cloudy appearance, sharp melting points, and high heats required for melting and properly fixing toner images to paper. Semicrystalline polymers usually have high melting points and heats for fixing images to paper, low optical clarity, and are less crystalline compared to the aforementioned crystalline polymers. The liquid crystalline polymers are usually cloudy in appearance, have multiple melting transitions with or without glass transitions, and are more highly ordered than liquid glass polymers. The amorphous polymer materials usually tend to be clear, possess no long or short range solid state order and have low glass transition temperatures. The liquid glass polymers and the coupled liquid glass polymers of the present invention in embodiment theory, it is believed, exhibit a very limited amount of solid state order, that is intermediate between the aforementioned randomly ordered amorphous polymers and the semicrystalline polymers.

Anionic polymerization of styrene and butadiene allows for the preparation of random, block or multiblock copolymers with precise control of molecular weight, stereochemistry of the diene component, and monomer content and sequence. This high degree of architectural control is made possible since, for example, anionic polymerization conditions generate "living" polymers wherein the styrene and butadiene may be interchanged during the polymerization process by the operator. Hence, unique A-B type multiblock polymer compositions may be prepared as illustrated herein.

Further, by in situ chemical coupling of the living anionic multiblock polymers, the molecular weight, molecular weight distribution and melt rheology may be increased and altered favorably toward the resulting performance properties when the coupled resins are formulated into low melt toner compositions.

Generally, the coupled multiblock polymers of the present invention in embodiments thereof are prepared by first generating an appropriate anionic initiator. This can be achieved by combining lithium metal or an organolithium compound, for example alkyl lithium compounds, with, for example, an alkyl group of from 1 to about 20 carbon atoms such as methyl, ethyl, propyl, butyl, pentyl, hexyl, octyl, nonyl, decyl, dodecyl and the like, or aryllithium compounds with, for example, an aryl group of from 6 to about 24 carbons such as phenyl, naphthyl, and the like, with a vinyl substituted aromatic compound containing at least one and preferably two or more reactive double bonds, or an aromatic compound containing active hydrogens; that is acidic hydrogens that will be metallated in the presence of the lithium metal, or the lithium compound. Preferred examples of alkyl lithium or aryl lithium compounds include butyl lithiums such as n-butyllithium and sec-butyllithium and phenyllithium, and the like. Preferred examples of vinyl substituted aromatic compounds containing at least one and preferably two or more reactive double bonds are styrene, alpha-methylstyrene, diisopropenyl benzene, triisopropenyl benzene, tetraisopropenyl benzene, and the like. Preferred examples of aromatic compounds containing active methylene groups are tetraphenyl ethane, tetraphenyl butane, tetraphenyl hexane, bis(diphenyl propyl) ether, and the like. Preferred examples of aromatic compounds containing active hydrogens are, for example, naphthalene, anthracene, phenanthracene and the like.

The alkyl lithium or aryl lithium compound can be added in an appropriate stoichiometry such that the molar equivalents of lithium compound are equal to the number of reactive double bond equivalents or active hydrogen equivalents contained in the vinyl substituted aromatic compound or active hydrogen containing aromatic compound, respectively. With the initiator thus formed in situ, as evidenced, for example, by an intense red color indicative of the presence of reactive vinyl substituted aromatic anion species, the cooled reaction mixture is treated with a single solution containing both monomer reactants, simultaneously or sequentially with solutions containing the separated reactant monomers, for example styrene and butadiene. The solvents employed can be comprised of mixtures of polar aprotic, for example tetrahydrofuran, diethyl ethers and dimethoxy ethane, and nonpolar aprotics, for example cyclohexane or hexanes. The order of addition of the reactants, the rate of addition, the time interval between sequential additions, and relative reaction ratio of reactant monomers, that is the relative rate at which the reactants react with the initiator or the growing polymer chain can determine the discrete architectural structure of the intermediate multiblock polymer units prior to further assembly upon coupling. Examples of the aforementioned include Types 1 through 5 described herein.

The molar equivalent ratio of reactive monomers, that enables multiblocks of the type A and B, ranges in embodiments of the present invention from about 10 to 1 to about 1 to 10 depending, for example, upon the rheological properties desired in the final coupled product resin. A reactive monomer molar equivalent ratio of A to B of from about 5 to 1 to about 1 to 5 is preferred and a molar equivalent ratio of 2 to 1 to about 1 to 2 is more preferred. The amount of initiator employed in the reactions is a minor amount relative to the reactive monomer. Typical molar equivalent ratios of initiator to reactive monomer are from about 1 to 10 to about 1 to 100, a ratio of about 1 to 50 to about 1 to 70 being preferred. Formation of the active initiator can be performed at about room temperature and above depending on the reactivity of the reagents, for example a temperature of between about 10° C. and about 100° C., and preferred temperatures of between about 25° C. and about 75° C. The polymerization reactions, that is the reaction of monomers with the initiator and subsequently reaction of the monomers with the growing polymer chain is dependent upon the desired regiochemistry of the product. If, for example, cyclohexane solvent is used exclusively in the reaction, a high 1,4-olefinic butadiene regioisomer content is obtained under conditions requiring 0° to 100° C., and preferably 50° C., and about four hours reaction time. High 1,2-butadiene regioisomer enchainments are achieved by carrying out reactions at low temperatures in the range of −100° C. to about 25° C., and preferably −20° C., to moderate the rate of reaction, the ordering of reactants and the exothermicity of the reaction in the presence of polar aprotic solvents, for example tetrahydrofuran. The completed polymerization reaction mixture, as indicated by the reappearance of a persistent "living anion"

color after all scheduled additions of reactants are accomplished, is allowed to warm to room temperature slowly over several hours then treated with a coupling agent before the reaction is quenched with the addition of polar aprotic solvents, such as methanol or a secondary reactant, to afford an end group modified product (Y or Y'), for example carbon dioxide. The "living dianion" color is dependent upon the predominant terminal anionic species in the polymer chain, for example the terminal 1,4-butadiene regioisomer anion is straw yellow color, the 1,2 butadiene regioisiomer anion is a muddy brown color, and the styrene anion is red. A different color scheme is observed when mono-initiators, such as n-butylithium, are used rather than di-initiators. The color and regioselectivity of the butadiene regioisomers are dependent upon the solventing of the anionic species and ion pairing phenomena. Optionally, with Type 6 coupled liquid glass resins, the polymerization reaction mixture is treated with a suitable coupling agent prior to being quenched with a reactive but nonpolymerizable ionic species before the aforementioned aprotic solvent quench. The products are isolated in nearly quantitative yields based on the weight of total monomer A and B, reactive initiator, reacted coupling agent and incorporated ionic or nonionic quenchants added to the reaction mixture, and are purified as necessary by repeated washing, dissolution and reprecipitation. The coupled multiblock polymer products are identified and characterized using standard methods, many of which are common to modern polymer technology practice as described in the aforementioned published polymer references and which become evident from a review of the working Examples that follow.

In another embodiment, the aforementioned coupled liquid glass resin Types 1 through 6 may be catalytically hydrogenated, partially or exhaustively, to convert olefinic double bonds in the polymer chain backbone and pendant groups into the corresponding saturated hydrocarbon functionality. In many instances, hydrogenation of coupled liquid glass resins can provide further control of the variety of rheological properties that may be obtained from multiblock polymer resins. Hydrogenation of coupled liquid glass resin Types 1 through 6 produces the aforementioned coupled liquid glass resins of Type 7. Hydrogenation is accomplished with a solution of the coupled multiblock polymer in contact with an effective amount, for example from about 10 to about 25 percent, of hydrogen gas under pressure in the presence of an appropriate catalyst, for example the known Wilkinson's catalyst.

In another embodiment, the aforementioned coupled liquid glass resin Types 1 through 6 may be halogenated, partially or exhaustively, to convert olefinic double bonds in the polymer chain backbone and pendant groups into the corresponding halogenated hydrocarbon functionality. In many instances, halogenation of coupled liquid glass resins affords further control of the variety of rheological properties that may be obtained from coupled multiblock polymer resins. Halogenation of liquid glass resin Types 1 through 6 produces the aforementioned coupled liquid glass resins of Type 8. Halogenation is accomplished with a solution of the coupled multiblock polymer in contact with an effective amount of from 0.1 to about 5 double bond molar equivalents of halogen gas or liquid dissolved in an organic solvent, for example chlorine gas or liquid bromine dissolved in carbon tetrachloride under slight negative pressure.

The number of blocks contained in the multiblock polymer resins prior to coupling of the present invention may be determined as illustrated, for example, from the above formulas, for example, wherein n = the number of repeated and essentially continuous diblock (A-B) polymer or (C) segments, o represents the number of repeated and essentially continuous (B) segments, p represents the number of polymer arms or chains that extend from the initiator site I, that is the number of reactive sites on the initiator, for example diisopropenyl benzene has two reactive olefin sites and leads to a polymer that propagates bidirectionally affording a product containing two arms, therefore p is equal to 2.

The letter q equals the number of operator controlled additions of either the glassy A component monomer or the liquid B component monomer. A letter q' equals the number of operator controlled additions of a mixture of both the glassy A component monomer and the liquid B component monomer.

The addition of the glassy A component monomer or the liquid B component monomer to the reaction mixture leads to the formation of one or more blocks of A or B, respectively, depending upon the number of points of initiation p.

The addition of a single solution containing a mixture of both the glassy A component monomer and the liquid B component monomer, referred to by the aforementioned q', leads to the formation of two times the number of blocks, that is $q' \times 2$. In general, the B component diene monomer is chosen such that it initially reacts faster and in preference to the glassy A component monomer contained in the mixture. The resulting polymer extension is essentially a diblock addition of the form, I—B—C, to each initiation or chain propagation site wherein B is essentially an all B liquid component block and C is the aforementioned graded (A—B) block. The addition of polar aprotic solvents, for example tetrahydrofuran or diethyl ether, promotes and results in graded C type blocks.

The coupled multiblock polymers of the present invention usually consume less energy in attaching the toner to a substrate, that is for example their heat of fusion is usually less than the semicrystalline polymers, a high heat of fusion being about 250 Joules/gram; and the heat of fusion being the amount of heat needed to effectively and permanently fuse the toner composition to a supporting substrate such as paper. The coupled multiblock polymers of the present invention also consume less energy because the processing characteristics of the toner polymers are sufficiently brittle so as to facilitate micronization, jetting and classification of the bulk toner composition to particles of appropriate functional toner dimensions. In addition, the aforementioned polymers generally possess a number average molecular weight of from about 3,000 to about 70,000, and have a dispersity $M_w/M_n$ ratio of about 1.2 to about 5. In general, if glossy toner resins are desired, a dispersity $M_w/M_n$ ratio of about 20 or less is preferred and $M_n$ values less than 35,000 are preferred. If low gloss resins are preferred, $M_n$ should be greater than 35,000 or $M_w/M_n$ ratios greater than 2 and preferably 5. Moreover, toner polymers with high $M_w$, for example, greater than 35,000 are more flexible and less likely to crack when images are creased.

The aforementioned toner resin coupled multiblock polymers are generally present in the toner composition in various effective amounts depending, for example, on the amount of the other components, and the like. Generally, from about 70 to about 95 percent by weight of the coupled multiblock resin is present, and preferably from about 80 to about 90 percent by weight.

Numerous well known suitable pigments, colorants, or dyes can be selected as the colorant for the toner particles including, for example, carbon black, like REGAL 330® available from Cabot Corporation, nigrosine dye, lamp black, iron oxides, magnetites, and mixtures thereof. The pigment, which is preferably carbon black, should be present in a sufficient amount to render the toner composition highly colored. Thus, the pigment particles are present in amounts of from about 2 percent by weight to about 20 percent, and preferably from about 2 to about 10 weight percent based on the total weight of the toner composition, however, lesser or greater amounts of pigment particles may be selected in embodiments of the present invention.

Various magnetites, which are comprised of a mixture of iron oxides ($FeO.Fe_2O_3$) in most situations including those commercially available such as MAPICO BLACK TM, can be selected for incorporation into the toner compositions illustrated herein. The aforementioned pigment particles are present in various effective amounts; generally, however, they are present in the toner composition in an amount of from about 10 percent by weight to about 30 percent by weight, and preferably in an amount of from about 16 percent by weight to about 19 percent by weight. Other magnetites not specifically disclosed herein may be selected.

A number of different charge enhancing additives may be selected for incorporation into the bulk toner, or onto the surface of the toner compositions of the present invention to enable these compositions to acquire a positive charge thereon of from, for example, about 10 to about 35 microcoulombs per gram as determined by the known Faraday Cage method for example. Examples of charge enhancing additives include alkyl pyridinium halides, including cetyl pyridinium chloride, reference U.S. Pat. No. 4,298,672, the disclosure of which is totally incorporated herein by reference; organic sulfate or sulfonate compositions, reference U.S. Pat. No. 4,338,390, the disclosure of which is totally incorporated herein by reference; distearyl dimethyl ammonium methyl sulfate, reference U.S. Pat. No. 4,560,635, the disclosure of which is totally incorporated herein by reference; and other similar known charge enhancing additives, such as distearyl dimethyl ammonium bisulfate, and the like, as well as mixtures thereof in some embodiments. These additives are usually present in an amount of from about 0.1 percent by weight to about 15 percent by weight, and preferably these additives are present in an amount of from about 0.2 percent by weight to about 5 percent by weight. A number of different charge enhancing additives may be selected for incorporation into the bulk toner, or onto the surface of the toner compositions of the present invention to enable these compositions to acquire a negative charge thereon of from, for example, about −10 to about −35 microcoulombs per gram. Examples of negative charge enhancing additives include alkali metal aryl borate salts, for example potassium tetraphenyl borate, reference U.S. Pat. Nos. 4,767,688 and 4,898,802, the disclosures of which are totally incorporated herein by reference; the aluminum salicylate compound BONTRON E-88 TM available from Orient Chemical Company, reference for example U.S. Pat. No. 4,845,033; the metal azo complex TRH available from Hodogaya Chemical Company; and the like.

Moreover, the toner composition can contain as internal or external components other additives, such as colloidal silicas inclusive of AEROSIL ®, metal salts, such as titanium oxides, tin oxides, tin chlorides, and the like, metal salts of fatty acids such as zinc stearate, reference U.S. Pat. Nos. 3,590,000 and 3,900,588, the disclosures of which are totally incorporated herein by reference, and waxy components, particularly those with a molecular weight of from about 1,000 to about 15,000, and preferably from about 1,000 to about 6,000, such as polyethylene and polypropylene, which additives are generally present in an amount of from about 0.1 to about 5 percent by weight.

The toner composition of the present invention can be prepared by a number of known methods including melt blending the toner resin particles, and pigment particles or colorants, followed by mechanical attrition. Other methods include those well known in the art such as spray drying, melt dispersion, dispersion polymerization, extrusion, and suspension polymerization; known micronization and classification of the toner can be accomplished in embodiments to enable toner particles with an average diameter of from about 10 to about 25 microns.

Characteristics associated with the toner compositions of the present invention in embodiments thereof include a fusing temperature of less than about 225° to about 310° F. and a fusing temperature latitude between 25° and 50° F. or greater and a hot offset temperature of from about 250° to about 350° F. Moreover, it is believed that the aforementioned toners possess stable triboelectric charging values of from about 10 to about 40 microcoulombs per gram for an extended number of imaging cycles exceeding as determined by the known Faraday Cage method, for example, in some embodiments one million developed copies in a xerographic imaging apparatus, such as for example the Xerox Corporation 1075. Although it is not desired to be limited by theory, it is believed that two important factors for the slow, or substantially no degradation in the triboelectric charging values reside in the unique physical properties of the coupled multiblock resin selected, and moreover the stability of the carrier particles utilized. Also of importance in embodiments of the present invention is the consumption of less energy with the toner compositions since they can be fused at a lower temperature, that is about 230° F. to about 310° F. surface temperature compared with other conventional toners including those containing certain styrene butadiene resins which fuse at from about 300° to about 330° F. In addition, the coupled multiblock polymers possess in some embodiments the other important characteristics mentioned herein inclusive of a glass transition temperature of from about 24° to about 74° C. and preferably from about 24° to about 60° C.

As carrier particles for enabling the formulation of developer compositions when admixed in a Lodige blender, for example, with the toner these are selected various known components including those wherein the carrier core is comprised of steel, nickel, magnetites, ferrites, copper zinc ferrites, iron, polymers, mixtures thereof, and the like. Also useful are the carrier particles as illustrated in U.S. Pat. Nos. 4,937,166 and 4,935,326, the disclosures of which are totally incorporated herein by reference. These carrier particles can be prepared by mixing low density porous magnetic, or magnetically attractable metal core carrier particles with from, for example, between about 0.05 percent and about 3 percent by weight, based on the weight of the coated carrier particles, of a mixture of polymers until adherence thereof to the carrier core by mechanical impaction or electrostatic attraction; heating the mixture of carrier core particles and polymers to a temperature, for example, of between from about 200° F. to about 550° F. for a period of from about 10 minutes to about 60 minutes enabling the polymers to melt and fuse to the carrier core particles; cooling the coated carrier particles; and thereafter classifying the obtained carrier particles to a desired particle size.

In a specific embodiment of the present invention, there are provided carrier particles comprised of a core with a coating thereover comprised of a mixture of a first dry polymer component, such as polyvinylidene fluoride (KYNAR ®), 60 weight percent, and a second dry polymer component, such as polymethyl methacrylate, 40 weight percent, and wherein the coating weight is from about 0.1 to about 1 weight percent. The aforementioned carrier compositions can be comprised of known core materials including iron with a dry polymer coating mixture thereover. Subsequently, developer compositions of the present invention can be generated by admixing the aforementioned carrier particles with the toner compositions comprised of the liquid glass resin particles, pigment particles, and other additives.

Thus, a number of suitable solid core carrier materials can be selected. Characteristic carrier properties of importance include those that will enable the toner particles to acquire a positive or negative charge, and carrier cores that will permit desirable flow properties in the developer reservoir present in the xerographic imaging apparatus. Also of value with regard to the carrier core properties are, for example, suitable magnetic characteristics that will permit magnetic brush formation in magnetic brush development processes; and also wherein the carrier cores possess desirable mechanical aging characteristics. Preferred carrier cores include ferrites, and sponge iron, or steel grit with an average particle size diameter of from between about 30 microns to about 200 microns.

Illustrative examples of polymer coatings selected for the carrier particles include those that are not in close proximity in the triboelectric series. Specific examples of polymer mixtures selected are polyvinylidenefluoride with polyethylene; polymethylmethacrylate and copolyethylenevinylacetate; copolyvinylidene fluoride tetrafluoroethylene and polyethylene; polymethylmethacrylate and copolyethylene vinylacetate; and polymethylmethacrylate and polyvinylidene fluoride. Other coatings, such as polyvinylidene fluorides, fluorocarbon polymers including those available as FP-461, a copolymer of vinyl chloride and trifluorochloroethylene, available from Occidental Chemical, terpolymers of styrene, methacrylate, and triethoxysilane, polymethacrylates, reference U.S. Pat. Nos. 3,467,634 and 3,526,533, the disclosures of which are totally incorporated herein by reference, and not specifically mentioned herein can be selected providing the objectives of the present invention are achieved.

With further reference to the polymer coating mixture, by close proximity as used herein it is meant that the choice of the polymers selected are dictated by their position in the triboelectric series, therefore, for example, one may select a first polymer with a significantly lower triboelectric charging value than the second polymer. Other known carrier coatings may be selected, such as fluoropolymers like KYNAR 301F ®, styrene terpolymers, trifluorochloroethylene/vinylacetate copolymers, polymethacrylates, and the like, at carrier coating weights of, for example, from about 0.1 to about 5 weight percent.

The carrier coating for the polymer mixture can be present in an effective amount of from about 0.1 to about 3 weight percent for example. The percentage of each polymer present in the carrier coating mixture can vary depending on the specific components selected, the coating weight, and the properties desired. Generally, the coated polymer mixtures used contain from about 10 to about 90 percent of the first polymer, and from about 90 to about 10 percent by weight of the second polymer. Preferably, there are selected mixtures of polymers with from about 30 to about 60 percent by weight of the first polymer, and from about 70 to about 40 percent by weight of a second polymer. In one embodiment of the present invention, when a high triboelectric charging value is desired, that is exceeding 30 microcoulombs per gram, there is selected from about 50 percent by weight of the first polymer such as a polyvinylidene fluoride commercially available as KYNAR 301F ®, and 50 percent by weight of a second polymer such as polymethylacrylate or polymethylmethacrylate. In contrast, when a lower triboelectric charging value is required, less than, for example, about 10 microcoulombs per gram, there is selected from about 30 percent by weight of the first polymer, and about 70 percent by weight of the second polymer.

Generally, from about 1 part to about 5 parts by weight of toner particles are mixed with 100 parts by weight of the carrier particles illustrated herein enabling the formation of developer compositions.

Also encompassed within the scope of the present invention are colored toner compositions comprised of toner resin particles, and as pigments or colorants, red, blue, green, brown, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as Cl 60720; Cl Dispersed Red 15, a diazo dye identified in the Color Index as Cl 26050; Cl Solvent Red 19; and the like. Examples of cyan materials that may be used as pigments include copper tetra-4(octadecyl sulfonamido) phthalocyanine; X-copper phthalocyanine pigment listed in the Color Index as Cl 74160; Cl Pigment Blue; and Anthrathrene Blue, identified in the Color Index as Cl 69810; Special Blue X-2137; and the like; while illustrative examples of yellow pigments that may be selected are diarylide yellow 3,3-dichlorobenzidene acetoacetanilides, a monoazo pigment identified in the Color Index as Cl 12700; Cl Solvent Yellow 16, a nitrophenyl amine sulfonamide identified in the Color Index as Foron Yellow SE/GLN; Cl Dispersed Yellow 33, a 2,5-dimethoxy-4-sulfonanilide phenylazo-4'-chloro-2,5-dimethoxy acetoacetanilide; Permanent Yellow FGL; and the like. These pigments are generally present in the toner composition in an amount of from about 1 weight percent to about 15 weight percent based on the weight of the toner resin particles.

The toner and developer compositions of the present invention may be selected for use in electrophotographic imaging processes containing therein conventional photoreceptors, including inorganic and organic photoreceptor imaging members. Examples of imaging members are selenium, selenium alloys, such as selenium tellurium, selenium arsenic, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules, there can be selected the aryl amines disclosed in the '990 patent. Also, there can be selected as photogenerating pigments squaraine compounds, azo pigments, perylenes, thiapyrillium materials, and the like. These layered members are conventionally charged negatively, thus usually a positively charged toner is selected for development. Moreover, the developer compositions of the present invention are particularly useful in electrophotographic imaging processes and apparatuses wherein there is selected a moving transporting means and a moving charging means; and wherein there is selected a flexible, including a deflected, layered imaging member, reference U.S. Pat. Nos. 4,394,429 and 4,368,970, the disclosures of which are totally incorporated herein by reference. Images obtained with the developer compositions of the present invention in embodiment theory possess acceptable solids, excellent halftones and desirable line resolution with acceptable or substantially no background deposits. The toner compositions of the present invention may also be used for single component electrophotographic imaging processes and direct electrostatic printing processes.

The following Examples are being supplied to further define the present invention, it being noted that these Examples are intended to illustrate and not limit the scope of the present invention. Parts and percentages are by weight unless otherwise indicated. Composition data is also presented.

Generally, for the preparation of toner compositions there was initially prepared the coupled multiblock polymer. Thereafter, there are admixed with the coupled multiblock resin polymers pigment particles and other additives by, for example, melt extrusion, and the resulting toner particles are jetted and classified to enable toner particles with an average volume diameter of from about 5 to about 25 microns, and preferably with an average volume diameter of from about 7 to about 15 microns as determined with, for example, a Coulter Counter.

Preparation of the Lithium/Naphthalene Initiator

Lithium shot (1.7 grams) packed in mineral oil (Lithcoa Corporation) was magnetically stirred with naphthalene (15 grams) in dry freshly distilled tetrahydrofuran (50 milliliters) for 16 hours at 25° C. in an argon purged amber sure-seal bottle equipped with a rubber septum. The resultant dark green lithium naphthalide solution was 2 molar in concentration as determined by titration with 0.1 molar hydrochloric acid and by size exclusion chromatographic analysis of the polymeric products obtained after reaction with multiblock component monomers.

Styrene-Butadiene Polymerizations Using Lithium/Naphthalene Initiator

Reaction vessels were typically thick walled glass beverage bottles or standard taper glass reactors equipped with magnetic stir bars and rubber septa. For example, tetrahydrofuran (300 milliliters) was added to the reaction vessel and titrated with the aforementioned lithium naphthalide initiator solution until a green color persisted for several minutes. The lithium naphthalide initiator obtained from the above process was transferred via cannula under argon to a graduated cylinder and the appropriate measured volume of initiator solution was then transferred to the reaction vessel. The reaction vessel was cooled to from about −60° to about −10° C. in a bath containing a dry ice and 2-propanol slurry, and then styrene or butadiene in cyclohexane, or a mixture of both monomers were added until desired block length and molecular weight of the "living" anion liquid-glass polymer prior to coupling with a coupling agent were achieved.

The number average molecular weight was calculated as follows:

$M_n$=[400 (grams of monomer)] divided by [(milliliters of initiator)(molarity of initiator)].

The actual measured number average molecular weights are in substantial agreement with the theoretically calculated values for the parent or uncoupled multiblock polymer formation using the above formula.

EXAMPLE I

Preparation of Uncoupled Polymer

A five-liter, three-neck flask equipped with mechanical stirrer and two rubber septa was purged with argon. The flask was rinsed with a solution of cyclohexane (200 milliliters) and 1.3 molar sec-butyllithium (50 milliliters). This wash solution was removed from the flask using a cannula. Cyclohexane (200 milliliters) was then added, swirled briefly, and then decanted with a cannula. The combined washings were quenched with 2-propanol and discarded. Cyclohexane (500 milliliters), 1.3 molar sec-butyllithium (88 milliliters, 0.1144 mol), and diisopropenylbenzene initiator (I) (9.07 grams) were then added to the flask and heated 4 hours at 50° C. The reaction mixture was slowly cooled in a dry ice-isopropanol bath and then cyclohexane (500 milliliters) was added to the reaction mixture. Tetrahydrofuran (733 milliliters), distilled from sodium containing benzophenone, was added rapidly before the reaction mixture was allowed to freeze. The reaction flask was cooled using a dry ice-isopropanol bath at between −20° and 0° C. Styrene (450 milliliters, 401.8 grams), butadiene (230 milliliters, 158.2 grams) and cyclohexane (450 milliliters, 342.8 grams) were combined and added to the reactor avia cannula over 25 minutes. After 4 hours, the reaction mixture was allowed to warm gradually to 25° C. After 16 hours of stirring at 25° C., an aliquot (87.2 grams containing 20.51 grams of polymer) was withdrawn from the reaction mixture using a cannula. The aliquot was added to methanol, 4,000 milliliters, to precipitate a crude liquid-glass polymer product using a Waring blender that was collected by filtration and vacuum dried. A sample of the polymer freeze dried from benzene had a DSC glass transition temperature of 50° C. The GPC $M_w/M_n$ was 32,700/20,300 (trimodal). The calculated $M_n$ was 18,700 with a polydispersity of 2. The polymer was comprised of 75.3 weight percent of styrene and 24.7 weight percent of butadiene with 84 percent of the butadiene content as the 1,2-vinyl regioisomer as determined using 'H NMR spectrometry. The polymer product (92 percent) was made into toner by extrusion with 6 percent of REGAL 330® carbon black and 2 percent of cetyl pyridinium chloride charge control agent followed by micronization. The MFT was 116° C. and the HOT offset was 143° C. using a Xerox 5028 silicone roll fuser operated at 3.3 inches per second. The properties of this material are compared with chemically coupled polymer products and are shown in Table I that follows.

EXAMPLE II

Preparation of Dichlorodimethyl Silane Coupled Styrene-Butadiene Polymer of Example I Dichlorodimethylsilane (2.38 milliliters, 2.53 grams, 0.0196 mol) was added rapidly via syringe over a period of several seconds at 25° C. to the "living" anionic copolymer reaction mixture that remained after removal of the aliquot as described in Example I above. The reaction mixture immediately became thicker and turned from orange red to dark brown. After 16 hours of continuous stirring at 25° C., the reaction mixture was quenched with 2-propanol, 10 milliliters, and added to methanol, 4,000 milliliters, to precipitate a crude polymer product using a Waring blender that was collected by filtration and vacuum dried. The yield of coupled polymer product was 552.4 grams (99 percent theory considering the material removed in Example I). A sample of the polymer was freeze dried from benzene and had a DSC glass transition temperature of 47° C. The silane coupled polymer was comprised of styrene, 75 weight percent, and 25 weight percent of butadiene with 81.8 weight percent of the butadiene content as the 1,2-vinyl regioisomer, as determined using $^1$H NMR spectrometry. The GPC $M_w/M_n$ was 156,000/34,500.

The silane coupled polymer product (92 percent by weight) was made into toner by extrusion at 130° C. with 6 percent of REGAL 330® carbon black and 2 percent of cetyl pyridinium chloride charge control agent, followed by micronization of the extrudate. The resultant toner had a MFT at 127° C. and an HOT at 163° C. determined using a Xerox 5028 silicone roll fuser operated at 3.3 inches per second. Additional toner samples were prepared in a similar manner using a Haake melt blender operated at 130° C. for 15 and 20 minutes. A Xerox 1075 soft silicone roll fuser operated at 11 inches per second was used to evaluate xerographic prints for MFT and HOT. For example, toner made without coupling shown as the comparative Example III in Table I had a MFT at 132° C. and a HOT at 150° C. The toner made with silane coupled polymer product derived from in situ coupling of liquid glass type polymers using similar processing and evaluation techniques as described in Example I and indicated in Table I, footnote (a), had a MFT between 113° and 124° C. and a HOT at 170° C. This corresponds to a MFT reduction between −30° to 41° C. compared with conventional toner fusing at 154° C. and with between 46° and 57° C. fusing latitude. The properties of this material are compared with results for uncoupled product of Example I and are shown in Table I as Example II.

Preparation of Lithium/Naphthalene Catalyst

To a 1-liter, one neck flask were added naphthalene (45 grams) and lithium shot (5.1 grams) in mineral oil. The flask was equipped with a magnetic stir bar, and was then capped with a rubber septum. After an argon purge, freshly distilled tetrahydrofuran (300 milliliters) was then added under argon and the mixture was stirred for 16 hours. The molarity of this initiator solution was 2.38 molar as determined by an average of the GPC molecular weight results from six polymerization reactions.

EXAMPLE III

Preparation of Uncoupled Styrene-Butadiene Copolymer with Lithium/Naphthalene Catalyst A 1-liter beverage bottle was equipped with a stir bar and rubber septum. After an argon purge, tetrahydrofuran (300 milliliters, 262.7 grams) and cyclohexane (350 milliliters, 268.1 grams) were added by cannula under argon. Lithium/naphthalene initiator solution (approximately 0.5 milliliter) as prepared as illustrated herein was added dropwise until the solution was light yellow-green. Thereafter, 11 milliliters of 2.38 molar lithium/-naphthalene solution was added by a syringe. After cooling, the beverage bottle reactor in a dry ice/2-propanol bath at −30° C., styrene (100 milliliters, 91.6 grams) and butadiene (29.1 grams, 43 milliliters) combined were added over 5 minutes under argon. After 16 hours, an aliquot (30 milliliters) of the red reaction solution was removed by syringe and added to 2-propanol (800 milliliters) using a Waring blender to precipitate the polymer. The polymer was isolated by filtration, washed with methanol (500 milliliters), and vacuum dried to yield 5.2 grams of copolymer. The resultant white polymer was comprised of 77.52 weight percent of styrene and 22.48 weight percent of butadiene with 78.1 percent of the butadiene content as the 1,2-vinyl regioisomer as determined using $^1$H NMR spectrometry. The monomodal GPC $M_w/M_n$ was 26,162/18,499, and the glass transition temperature was 50.3° C. as determined by differential scanning calorimetry. The copolymer product was formulated into toner by extrusion at 130° C. with 6 weight percent of REGAL 330® carbon black and 2 weight percent of cetyl pyridinium chloride charge control agent, followed by micronization. The MFT of the resulting toner was 124° C. and the HOT was 146° C. using a Xerox 5028 silicone roll fuser operated at 3.3 inches per second. The properties of this material are compared with the chemically coupled product of Example IV.

EXAMPLE IV

Preparation of Dichlorodimethyl Silane Coupled Styrene-Butadiene Copolymer

Dichlorodimethyl silane (0.7 milliliter, 0.74 gram, 5.73 millimoles) was added rapidly via syringe over several seconds at 25° C. to the "living" red anionic copolymer reaction mixture that remained after removal of the aliquot as described above in Example III. The reaction mixture immediately became thicker and colorless. After 16 hours of continuous stirring at 25° C., the reaction mixture was quenched with 2-propanol (10 milliliters) and was added to 2-propanol (4,000 milliliters) to precipitate the polymer using a Waring blender. After filtration, the copolymer was washed with methanol (1,000 milliliters), isolated by filtration, and vacuum dried. The silane coupled polymer was comprised of 77.77 weight percent of styrene and 22.23 weight percent of butadiene with 81.5 percent of the butadiene content as the 1,2-vinyl regioisomer. The yield of copolymer was 111.6 grams (98.2 percent theoretical yield). The bimodal GPC $M_w/M_n$ was 48,277/23,773. The $T_{g\text{-}mid}$ was 50.5° C. as determined by differential scanning calorimetry. The silane coupled copolymer product was made into toner by extrusion at 130° C. with 6 weight percent of REGAL 330® carbon black and 2 weight percent of cetyl pyridinium chloride charge control agent, followed by micronization of the extrudate. The resultant toner had a MFT at 124° C. and a HOT at 155° C., determined using a Xerox 5028 silicone roll fuser operated at 3.3 inches per second. A toner formed by repeating the process of Example II and without the coupling polymer had a MFT at 124° C. and a HOT at 146° C. The toner prepared with a silane coupling of a liquid glass type polymer using similar processing and evaluation techniques as described in Example IV corresponds to a 30° MFT reduction with 31° C. fusing latitude compared with a conventional toner (styrene methacrylate resin, 92 weight percent, 8 weight percent of REGAL 330® carbon black, and 2 weight percent of cetyl pyridinium chloride) fusing at 154° C. with 35° C. fusing latitude. The properties of this material are compared with results for uncoupled products of Examples I and III, and are shown in Table I as follows.

EXAMPLE V

Carbon Black Toner

The polymer (46 grams) of Example II was extruded with a ZSK extruder between 110° and 120° F. with 3 grams of REGAL® 330 carbon black and 1 gram of cetyl pyridinium chloride charge control agent. After micronization to 10 micron particles by jetting, the glass transition temperature of the resultant toner was 55.4° C. The minimum fix temperature of the toner was 130° C. (+/−3° C.) with a standard Xerox Corporation 1075 fusing fixture operated at 11 to 11.5 inches per second. For the same toner fused using a standard Xerox Corporation fusing fixture operated at 3 to 3.3 inches per second, the minimum fix temperature was 125° F. The hot offset temperature for both the above tests was 153° C. (307° F.).

EXAMPLE VI

Cyan Toner

The polymer (50 grams) of Example II with 2 percent by weight of PV FAST BLUE TM pigment and 2 percent by weight of cetyl pyridinium chloride charge control agent was melt mixed in a Brabender Plastigraph for 30 minutes at 70° C. and then 30 minutes at 130° C. The resultant plastic was jetted into toner and combined with Xerox Corporation 1075 carrier (steel coated with polyvinyl fluoride) at 3.3 weight percent of toner concentration. A tribocharge value of 21 microcoulombs per gram with 2.98 percent of toner concentration was measured with a standard Faraday Cage blow-off apparatus. Images were developed on Hammermill laser printer paper and Xerox Corporation transparency stock. The DSC glass transition temperature was 52.3° C. The minimum fix temperature was 125° C. and the hot offset temperature was 154° F. with a Xerox Corporation 5028 silicone roll fuser operated at 3 inches per second. Excellent fused images suited to transparency projection were obtained on a transparency between 265° and 330° F. There was no visible offset of toner to the fuser roll at roll temperatures less than 335° F. Optimal projection efficiency was obtained by fusing at approximately 310° F. A gloss number of 50 was measured by fusing at 275° F.

EXAMPLE VII

Magneta Toner

The polymer (50 grams) of Example II with 5 percent by weight of HOSTAPERM PINK E TM pigment and 2 percent by weight of cetyl pyridinium chloride charge control agent was melt mixed in a Brabender Plastigraph for 30 minutes at 70° C. and then 30 minutes at 130° C. The resultant plastic was jetted into toner and combined with Xerox Corporation 1075 carrier at 3.3 weight percent of toner concentration. A tribocharge value of 30 microcoulombs per gram with 3.04 percent of toner concentration was measured with a standard Faraday Cage blow-off apparatus. The minimum fix temperature was 125° C. The pigment dispersion was satisfactory. The projection efficiency and gloss values measured were comparable to those of Example VI. A gloss value 50 was achieved at 277° F. Projectable fused images on transparency stock were obtained between 265° and 333° F. An improved dispersion of HOSTAPERM PINK TM in the toner was achieved by preparing a polymer dispersion as follows. A master batch of the polymer from Example II and HOSTAPERM PINK E TM in an equal weight ratio were heated in a Brabender Plastigraph at 130° C. for 30 minutes and then 70° C. for 30 minutes. Another sample of the polymer from Example II (44 grams), 1 gram of cetyl pyridinium chloride charge control agent and five grams of the aforementioned master batch pigment polymer dispersion were melt mixed in a Brabender Plastigraph for 20 minutes at 130° C. with a shear rate of 120 to 160 rpm, and then 20 minutes at 70° C. The resultant plastic was jetted into toner. Excellent pigment dispersion was achieved and improved transparency projection efficiency was observed with toner images fused at 270° F.

Other modifications of the present invention will occur to those skilled in the art subsequent to a review of the present application. These modifications, and equivalents thereof are intended to be included within the scope of this invention.

TABLE I

Styrene-Butadiene Liquid Glass Resins Coupled and Uncoupled (Control)

| Example | Tg °C. | Wt. % Buta-diene | % 1,2 Vinyl Buta-diene | GPC $M_w/M_n$ | Toner Melt Rheology $1/T_2$[h] | First Evaluation MFT/HOT °C.[a] | Second Evaluation MFT/HOT °C.[c,b] | Toner Particle Size (microns) | Fusing Latitude °C. | MFT Reduction °C. |
|---|---|---|---|---|---|---|---|---|---|---|
| uncoupled control | 52.3 | 26.1 | 85.3 | 35200/21900 | 95/120 | 121/166 | —[f] | —[f] | —[f] | —[f] |
| uncoupled control | 50.3 | 25.4 | 81.0 | 53500/27400 | 102/133 | 116/163 | 127/170[c] | 5[c] | 43 | 27 |
| uncoupled control | | | | | 100/132 | | 128/160[d] | 7[d] | 32 | 26 |

TABLE I-continued

| Example | Tg °C. | Wt. % Buta-diene | % 1,2 Vinyl Buta-diene | GPC $M_w/M_n$ | Toner Melt Rheology $1/T_2$[h] | First Evaluation MFT/HOT °C.[a] | Second Evaluation MFT/HOT °C.[c,b] | Toner Particle Size (microns) | Fusing Latitude °C. | MFT Reduction °C. |
|---|---|---|---|---|---|---|---|---|---|---|
| | Styrene-Butadiene Liquid Glass Resins Coupled and Uncoupled (Control) | | | | | | | | | |
| I (uncoupled control) | 50.0 | 24.7 | 84.0 | 32700/20300 | 96/124 | 116/143 | | | | |
| II (coupled)[e] | 46.9 | 25.0 | 81.8 | 156000/34500 | 99/150 | 127–132/163 | 113/170[c] | 5[c] | 57 | 41 |
| II (duplicate coupled)[e] | | | | | | | 124/170[d] | 11[d] | 46 | 30 |
| III (uncoupled control) | 51.6 | 24.5 | 83.1 | 42320/24450 | 96/124 | 116/121/154 | 132/150[c] | 7[c] | 18 | 22 |
| uncoupled control | 54.1 | 21.7 | 83.6 | 37160/21860 | 100/126 | 121/154 | 137/150[c] | 9[c] | 13 | 17 |
| uncoupled control | 56.2 | 18.0 | 90.0 | 26900/16700 | 102/125 | 132/177 | —[f] | —[f] | —[f] | —[f] |
| uncoupled control[g] | 58.2 | 11.0 | 0 | 134000/19200 | 106/154 | 150/—[f] | 150/—[f] | —[f] | —[f] | —[f] |

[a]determined using tape test and a Xerox 5028 silicone-fuser roll operated at 3.3 inches/second.
[b]determined using crease test and a Xerox 1075 silicone roll fuser operated at 11 inches/second.
[c]processed 15 minutes in a Haake melt blender at 130° C.
[d]processed 20 minutes in a Haake melt blender at 130° C.
[e]dichlorodimethylsilane coupled product obtained from intermediate reaction product of Example I.
[f]not determined.
[g]free radical suspension polymerized styrene-butadiene copolymer.
[h]where $T_1 = 7.5 \times 10^4$ poise [eta' at 10 radius/second] and $T_2 = 4.5 \times 10^3$ poise [eta' at 10 radius/second].

What is claimed is:

1. A toner composition comprised of chemically coupled multiblock liquid glass resin particles with a glass transition temperature of between from about 20° C. to about 65° C., and pigment particles.

2. A toner composition in accordance with claim 1 wherein the chemically coupled multiblock resin is of the formula $$Q[-(A-B)_n-Y]_m$$

wherein A represents the glass segment, B represents the liquid segment, n is at least 2 and represents the number of A and B segments, m is the number of reactive sites on the coupling agent Q, and Y is a chain terminating group.

3. A toner composition in accordance with claim 2 wherein n is a number of from about 2 to about 100.

4. A toner composition in accordance with claim 2 wherein from about 2 to about 100 A segments are present.

5. A toner composition in accordance with claim 2 wherein from about 2 to about 100 B segments are present.

6. A toner composition in accordance with claim 2 wherein the A segments are comprised of a polystyrene, and the B segments are comprised of a polybutadiene.

7. A toner composition in accordance with claim 2 wherein the coupled multiblock polymer is disubstituted bis[poly(styrene-1,2-butadiene] dimethyl silane of the formula $$(CH_3)_2\ Si[poly(styrene\text{-}1,2\text{-}butadiene)]_2.$$

8. A toner composition in accordance with claim 1 wherein the resin particles have a number average molecular weight of from about 3,000 to about 70,000.

9. A toner composition in accordance with claim 2 wherein the resin particles dispersity ratio $M_w/M_n$ is from about 1 to about 15.

10. A toner composition in accordance with claim 2 wherein the pigment particles are selected from the group consisting of carbon black, magnetites, and mixtures thereof; or wherein the pigment particles are selected from the group consisting of red, blue, green, brown, cyan, magenta, yellow, and mixtures thereof.

11. A toner composition in accordance with claim 1 containing charge enhancing additives.

12. A toner composition in accordance with claim 11 wherein the charge enhancing additives are selected from the group consisting of alkyl pyridinium halides, organic sulfates, organic bisulfates, organic sulfonates, distearyl dimethyl ammonium methyl sulfates, distearyl dimethyl ammonium bisulfates, cetyl pyridinium lakes, polyvinyl pyridine, tetraphenyl borate salts, phosphonium salts, nigrosine, metal-salicylate salts, aminohydroxy substituted naphthalene sulfonate quaternary ammonium salts, aluminium salicylate salts, polystyrene-polyethylene oxide block copolymer salt complexes, poly(dimethyl amino methyl methacrylates), and metal azo dye complexes.

13. A toner composition in accordance with claim 2 wherein the triboelectric charge on the toner is from about a positive or negative 5 to about 35 microcoulombs per gram, and the toner composition has a fusing temperature of between about 220° F. to about 310° F.

14. A developer composition comprised of the toner composition of claim 1, and carrier particles.

15. A developer composition in accordance with claim 14 wherein the carrier particles are comprised of a core of steel, iron, or ferrites.

16. A developer composition in accordance with claim 14 wherein the carrier particles include thereover a polymeric coating.

17. A method for developing images which comprises the formation of an electrostatic latent image on a photoconductive member; developing the resulting image with the toner composition of claim 1; subsequently transferring the developed image to a suitable substrate; and thereafter permanently affixing the image thereto.

18. A toner composition in accordance with claim 2 wherein B is atactic poly-1,2-butadiene, cis and trans poly-1,4-butadiene, hydrogenated cis and trans poly-1,2-butadiene or 1,2-vinyl polybutadiene.

19. A toner composition in accordance with claim 2 containing chemically coupled multi-segmented block polymers wherein B is poly(cyclooctene) or hydrogenated poly(cyclooctene).

20. A toner composition comprised of the chemically coupled particulate multiblock polymers of the formula $$Q[(A—B)_n]_m—A$$

wherein n is a number of from 2 to about 100, and wherein both ends of the polymer chain are terminated with a glassy component A; m represents the number of reactive sites on the coupling agent Q; and wherein A is polystyrene and B is polybutadiene.

21. A toner composition in accordance with claim 1 containing chemically coupled multiblock resin particles of the formula $$Q\{[A—(C)_n—]_p—I\}_m$$

wherein n is a number of from 1 to about 50, p is a number of from 1 to 4 and represents the number of arms that extend radially, I is the point of initiation; m is the number of reactive sites on the coupling agent Q; and wherein A is polystyrene and C is a gradient multiblock polymer of poly(styrene-butadiene).

22. A toner composition in accordance with claim 1 containing chemically coupled multiblock resin particles of the formula $$Q\{[A—(C)_n—(B)_o—]_p—I\}$$

wherein n is a number of from 2 to about 50, o is a number of from 1 to about 25, and p is a number of from 1 to 4; Q is a coupling agent component; and wherein A is polystyrene, B is polybutadiene, and C is a gradient multiblock polymer of poly(styrene-butadiene).

23. A toner composition in accordance with claim 1 containing chemically coupled multiblock resin particles of the formula $$Q\{[A—\{—(C)_n—(B)_o—\}_q—]_p—I\}_m$$

wherein n is a number of from 2 to about 50, o is a number of from 1 to about 25, q is a number from 1 to 50, and p is a number of from 1 to 4; m is the number of reactive sites on the coupling agent Q; and wherein A is polystyrene, B is polybutadiene, and C is a gradient multiblock polymer of poly(styrene-butadiene).

24. A toner composition in accordance with claim 1 containing chemically coupled multiblock resin particles of the formula $$Y'—Z—Y'$$

wherein Y' is an ionizable radical on both ends of the coupled polymer chain, and Z is a coupled multiblock copolymer; or of the formula $$Z—Y'$$

wherein Y' is an ionizable group on the end of the coupled polymer chain, and Z is a coupled multiblock copolymer.

* * * * *